US008484876B2

(12) United States Patent
Mossberg et al.

(10) Patent No.: US 8,484,876 B2
(45) **Date of Patent: *Jul. 16, 2013**

(54) FIREARMS FOR LAUNCHING ELECTRIFIED PROJECTILES

(75) Inventors: Alan I. Mossberg, Tierra Verde, FL (US); Alan Iver Mossberg, Jr., Branford, CT (US); William C. Lutton, Winsted, CT (US); Joseph H. Bartozzi, Woodbridge, CT (US); Mark A. Hanchett, Phoenix, AZ (US); Patrick W. Smith, Scottsdale, AZ (US)

(73) Assignee: O.F. Mossberg & Sons, Inc., North Haven, CT (US)

( * ) Notice: Subject to any disclaimer, the term of this patent is extended or adjusted under 35 U.S.C. 154(b) by 225 days.

This patent is subject to a terminal disclaimer.

(21) Appl. No.: 13/043,024

(22) Filed: Mar. 8, 2011

(65) Prior Publication Data

US 2011/0203151 A1 Aug. 25, 2011

Related U.S. Application Data

(63) Continuation-in-part of application No. 12/272,560, filed on Nov. 17, 2008, now Pat. No. 7,958,662.

(60) Provisional application No. 60/989,036, filed on Nov. 19, 2007.

(51) Int. Cl.

| | |
|---|---|
| ***F41A 17/00*** | (2006.01) |
| ***F41A 17/66*** | (2006.01) |
| ***F41A 3/00*** | (2006.01) |

(52) U.S. Cl.

USPC ..... 42/70.01; 42/70.08; 42/70.11

(58) Field of Classification Search

USPC ..... 42/70.01, 70.08, 70.011, 70.06, 70.11; 102/446, 464, 481

See application file for complete search history.

(56) References Cited

U.S. PATENT DOCUMENTS

| | | | |
|---|---|---|---|
| 1,650,908 | A | 11/1927 | Ramsey |
| 1,887,324 | A | 11/1932 | Pocoroba |
| 2,809,564 | A | 10/1957 | Pope |
| 3,089,420 | A | 5/1963 | Littleford |
| 3,320,886 | A | 5/1967 | De Luca |
| 3,404,598 | A | 10/1968 | Angelos |
| 3,407,526 | A | 10/1968 | Freed |
| 3,431,852 | A | 3/1969 | Fowler |
| 3,618,246 | A | 11/1971 | Woodring |
| 3,641,869 | A | 2/1972 | Buchanan et al. |
| 3,728,967 | A | 4/1973 | Hinkle |
| 3,786,761 | A | 1/1974 | Ciccone |
| 3,802,430 | A | 4/1974 | Schwebel |

(Continued)

*Primary Examiner* — Bret Hayes

(74) *Attorney, Agent, or Firm* — Donald S. Holland, Esq.; Holland & Bonzagni, P.C.

(57) ABSTRACT

Method and apparatus are disclosed for launching electrified projectiles from a firearm (preferably, a shotgun) by using a specially designed breech bolt which also prohibits firing lethal ammunition. The preferred method comprises: opening a receiver of a shotgun by retracting a breech bolt having a central protrusion on a leading end; inserting a cartridge, having an electrified projectile, into a breech of the firearm; wherein the electrified projectile contains a primer and adjacent pyrotechnic propellant; nesting an end portion of the cartridge within the protrusion of the bolt; propelling the electrified projectile from the firearm by striking a firing pin of the shotgun against the primer, thereby igniting the pyrotechnic propellant, of the nested electrified projectile; and prohibiting, by the central protrusion of the bolt, the firing of lethal ammunition from the firearm.

11 Claims, 4 Drawing Sheets

U.S. PATENT DOCUMENTS

| | | | | |
|---|---|---|---|---|
| 3,844,216 | A | 10/1974 | Jakobs | |
| 3,858,342 | A | 1/1975 | Langsford | |
| 3,859,746 | A | 1/1975 | Pecksen | |
| 3,983,817 | A | 10/1976 | Tucker | |
| 4,029,015 | A | 6/1977 | Lachaussee | |
| 4,221,065 | A | 9/1980 | Curran | |
| 4,315,462 | A | 2/1982 | Vollers | |
| 4,440,062 | A | 4/1984 | McQueen | |
| 4,478,150 | A | 10/1984 | Sayler | |
| 4,575,962 | A | 3/1986 | Rogak | |
| 4,738,202 | A | 4/1988 | Hebert | |
| 4,843,336 | A | 6/1989 | Kuo | |
| 4,918,825 | A | 4/1990 | Lesh et al. | |
| 4,938,146 | A | 7/1990 | Gunther | |
| 5,010,677 | A | 4/1991 | Verney | |
| 5,078,117 | A | 1/1992 | Cover | |
| 5,086,703 | A | 2/1992 | Klein | |
| 5,157,219 | A | 10/1992 | Calsson | |
| 5,177,318 | A | 1/1993 | Martinez | |
| 5,303,495 | A | 4/1994 | Harthcock | |
| 5,309,842 | A | 5/1994 | Matysik | |
| 5,685,100 | A | 11/1997 | Atchison | |
| 5,698,816 | A | 12/1997 | Roxby | |
| 5,714,710 | A | 2/1998 | Roach | |
| 5,786,546 | A | 7/1998 | Simson | |
| 5,791,327 | A | 8/1998 | Riggs | |
| 5,834,681 | A | 11/1998 | DuBay | |
| 5,900,577 | A | 5/1999 | Robinson | |
| 5,979,331 | A | 11/1999 | Casull | |
| 6,247,412 | B1 | 6/2001 | Vornfett | |
| 6,293,204 | B1 | 9/2001 | Regen | |
| 6,357,157 | B1 | 3/2002 | Constant | |
| 6,360,468 | B1 | 3/2002 | Constant | |
| 6,612,063 | B1 | 9/2003 | Sigg | |
| 6,640,722 | B2 | 11/2003 | Stogermuller | |
| 6,647,890 | B2 | 11/2003 | Findlay | |
| 6,732,465 | B2 | 5/2004 | Strayer | |
| 6,832,557 | B2 | 12/2004 | Torsten | |
| 6,862,994 | B2 | 3/2005 | Chang | |
| 6,976,431 | B2 | 12/2005 | Westrom | |
| 7,004,074 | B2 | 2/2006 | Van Stratum | |
| 7,143,697 | B2 | 12/2006 | Mace | |
| 7,150,231 | B2 | 12/2006 | Olofsson | |
| 7,581,344 | B2 | 9/2009 | Reynolds | |
| 7,878,120 | B1 * | 2/2011 | Nodarse et al. | 102/472 |
| 7,958,662 | B2 * | 6/2011 | Mossberg et al. | 42/70.01 |
| 2003/0145754 | A1 | 8/2003 | Saxby | |
| 2011/0056403 | A1 * | 3/2011 | Hays et al. | 102/481 |

* cited by examiner

FIREARMS FOR LAUNCHING ELECTRIFIED PROJECTILES

RELATED APPLICATIONS

This is a continuation-in-part patent application of U.S. Utility Patent Application Ser. No. 12/272,560, filed Nov. 17, 2008, now U.S. Pat. No. 7,958,662 entitled "Systems and Methods of a Weapon for Conditional Activation of a Cartridge" ("Applicants' Parent Application") which was based upon a U.S. Provisional Patent Application, Ser. No. 60/989,036, filed Nov. 19, 2007 entitled "Apparatus and Methods for Conditional Activation of a Cartridge" ("Applicants' Provisional Application"). Applicants hereby incorporate the disclosures of Applicants' Parent Application and Applicants' Provisional Application by reference in their entirety. Applicants hereby claim priority, under 35 U.S.C. §120, from Applicants' Parent Application (Ser. No. 12/272,560) and Applicants' Provisional Application (Ser. No. 60/989,036).

FIELD OF INVENTION

This invention relates generally to firearms. More particularly, it relates to the projectiles which firearms, such as long guns (e.g., shotguns and rifles), are capable of discharging.

BACKGROUND OF THE PRIOR ART

Law enforcement agencies (e.g., police departments) often face budgetary constraints in today's economy. It is difficult sometimes for police forces to buy new equipment or replenish worn equipment.

Law enforcement officers also face liability issues, when quelling suspects and mobs, due to today's litigious society. Law enforcement officers try to save innocent lives, not end them by accident.

Law enforcement officers therefore are trained to use non-lethal force, where the situation warrants. For example, rubber bullets or TASER® guns may be used to quell an unruly mob or an unruly inmate.

Some TASER® guns are one shot only. Then another TASER® gun has to be repurchased, if the law enforcement team is to be outfitted for the next encounter.

Accordingly, it is a primary object of the present invention to enable the firearm to fire electrified projectiles from cartridges.

It is another primary object to enable only propellant fired electrified projectiles to be launched, by using a special bolt, and not standard ammunition.

DETAILED DESCRIPTION OF THE PREFERRED EMBODIMENT

Applicants have disclosed a method and apparatus for launching electrified projectiles from firearms. A special breech bolt enables the electrified projectiles to be launched, but prevents lethal ammunition from being fired.

The preferred "apparatus" embodiment comprises: (a) a shotgun having a breech bolt; (b) wherein the breech bolt has a leading end (or face) with a central protrusion defining a recess; (c) a cartridge, with an electrified projectile, nested within the protrusion; (d) wherein the cartridge has a primer and a pyrotechnic propellant; (e) wherein the electrified projectile is propelled from the firearm by striking the firing pin against the primer, thereby igniting the pyrotechnic propellant; and (f) the protrusion also defines an excess space for prohibiting lethal ammunition from being discharged from the firearm, by virtue of the firing pin unable to reach the primer of the lethal ammunition due to the excess space.

BRIEF DESCRIPTION OF THE DRAWINGS

The above and other objects will become more readily apparent when the following description is read in conjunction with the accompanying drawings, in which.

DETAILED DESCRIPTION OF THE PREFERRED EMBODIMENTS

Figure 1:
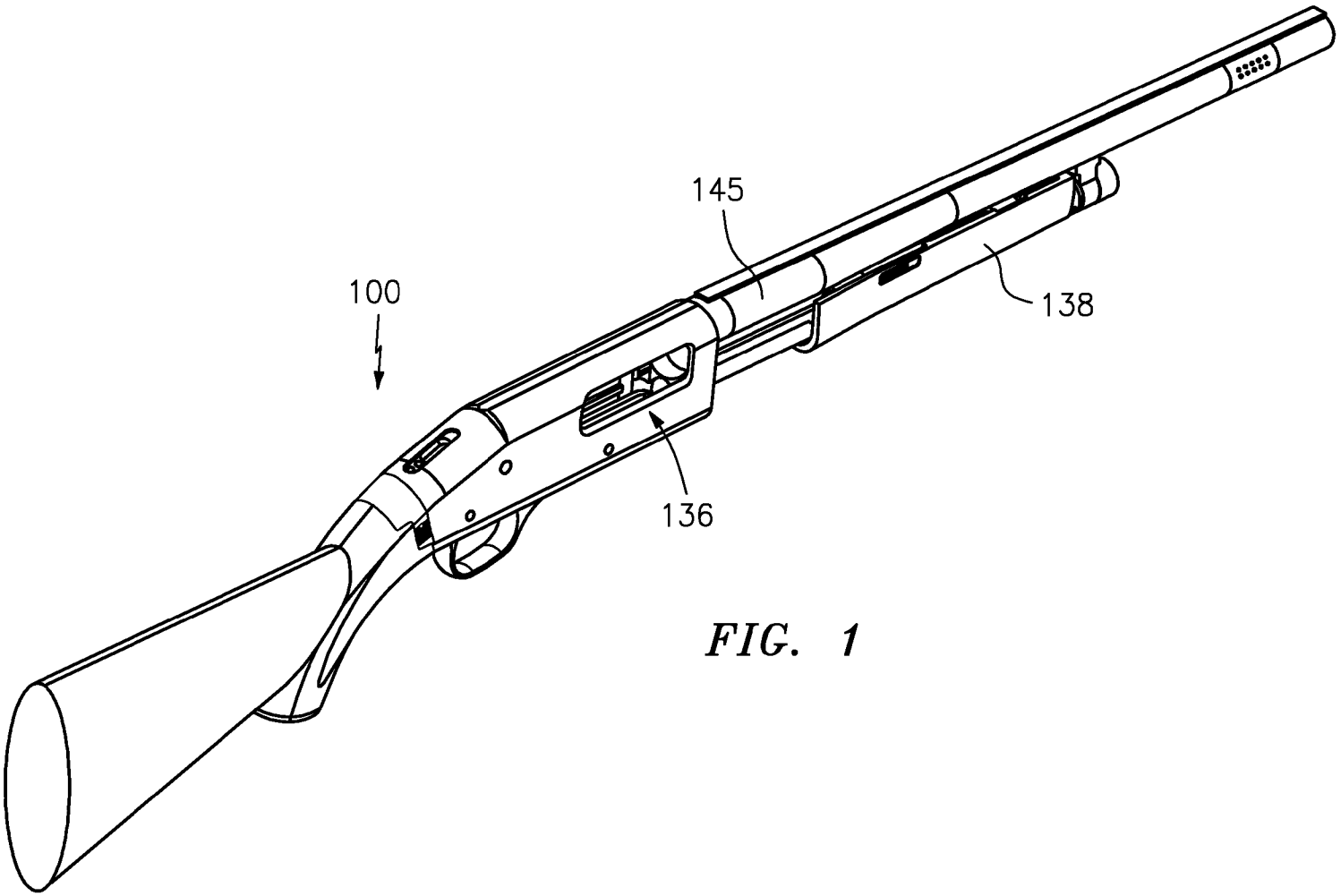
FIG. 1 depicts a pump shotgun manufactured by O.F. Mossberg & Sons, Inc.

Applicants have disclosed a preferred method and apparatus for launching electrified projectiles from a firearm (preferably, a shotgun), using an adapted breech bolt which prohibits the firearm from firing lethal ammunition.

As used herein, the term "lethal ammunition" is defined as ammunition capable of wounding or killing humans or animals. For shotguns, such ammunition is a self-contained cartridge (a "shotshell") having primarily: a case; a primer; gunpowder; and shot (e.g., buckshot) or a single slug. During shooting, a firing pin hits a primer, igniting it. The spark from the primer ignites the gunpowder. Expanding gases, from the burning powder, propel the shot (or slug) out the barrel.

Applicants, in this application, have drawn from prior descriptions (and drawings) from Applicants' Provisional Application and Applicants' Utility Application. Applicants have created a simplified disclosure to protect an actual product manufactured under a joint venture between Applicants' assignees, O.F. Mossberg & Sons, Inc. and TASER International.

Figure 6:
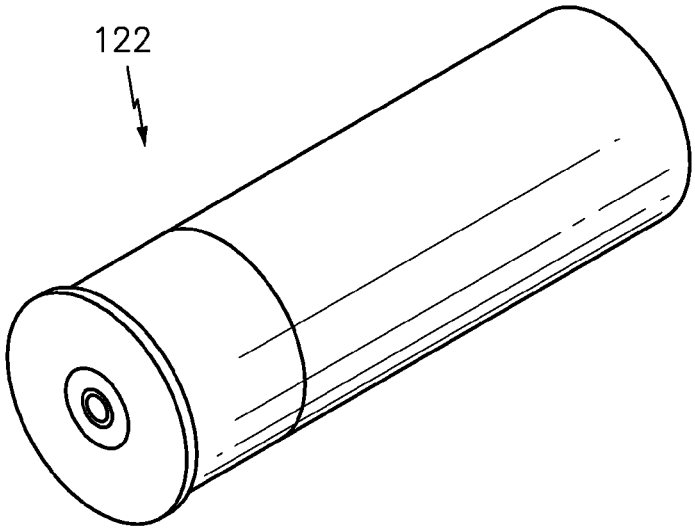
FIG. 6 is a perspective view of a shotshell.
Figure 7:
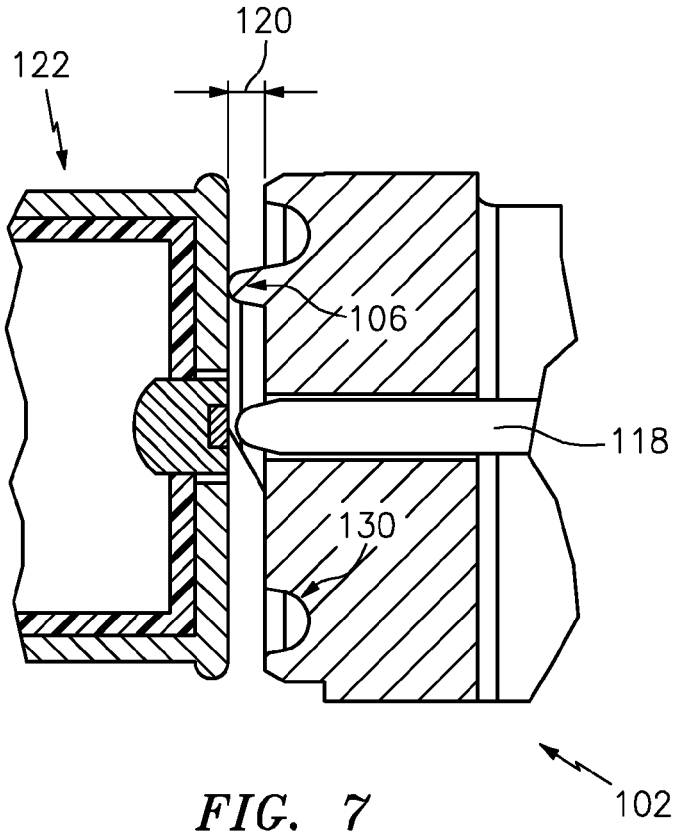
FIG. 7 is a cross-sectional view of the breech bolt creating an excess head space for an abutting shotshell.

That manufactured and preferred product comprises a. a firearm (preferably, a shotgun 100) comprising:

i. a breech bolt 102;

ii. wherein the bolt 102 has an end (or face) 104 with a central protrusion 106;

iii. wherein the protrusion 106 defines a recess 108;

b. a cartridge 110, with an electrified projectile 112, having an end portion 126 nested within the protrusion 106;

i. wherein the cartridge 110 has a primer 115 and a pyrotechnic propellant (at 116);

c. wherein the projectile 112 is propelled from the firearm by striking a firing pin 118 against the primer 115, which ignites the pyrotechnic propellant; and d. the protrusion 106 also defines an excess space 120 for prohibiting lethal ammunition (e.g., a shotshell 122) from being discharged from the firearm (see FIGS. 6-7).

Unlike the prior art, Applicants' marketed product involves a firearm (e.g., the illustrated shotgun 100) in which a specialized breech bolt 102 enables an electrified projectile 112 to be launched from the firearm; however, the breech bolt has a protrusion 106 which, if lethal ammunition (e.g., a shotshell 122) is inserted, prohibits that ammunition from being fired accidentally (see FIG. 7).

In Applicants' marketed product, the firing pin 118 is carried within a central throughbore 124 in the bolt 102, while the firearm's trigger mechanism is at rest. To launch the electrifed projectile 112, the firing pin 118 (upon a complete trigger pull) slides in the bore 124 until its tip strikes the primer 115, thereby igniting the pyrotechnic propellant (at 116). The firing pin 118 can reach the primer 115 because the cartridge 110, with the electrified projectile 112, is nested.

Figure 3:
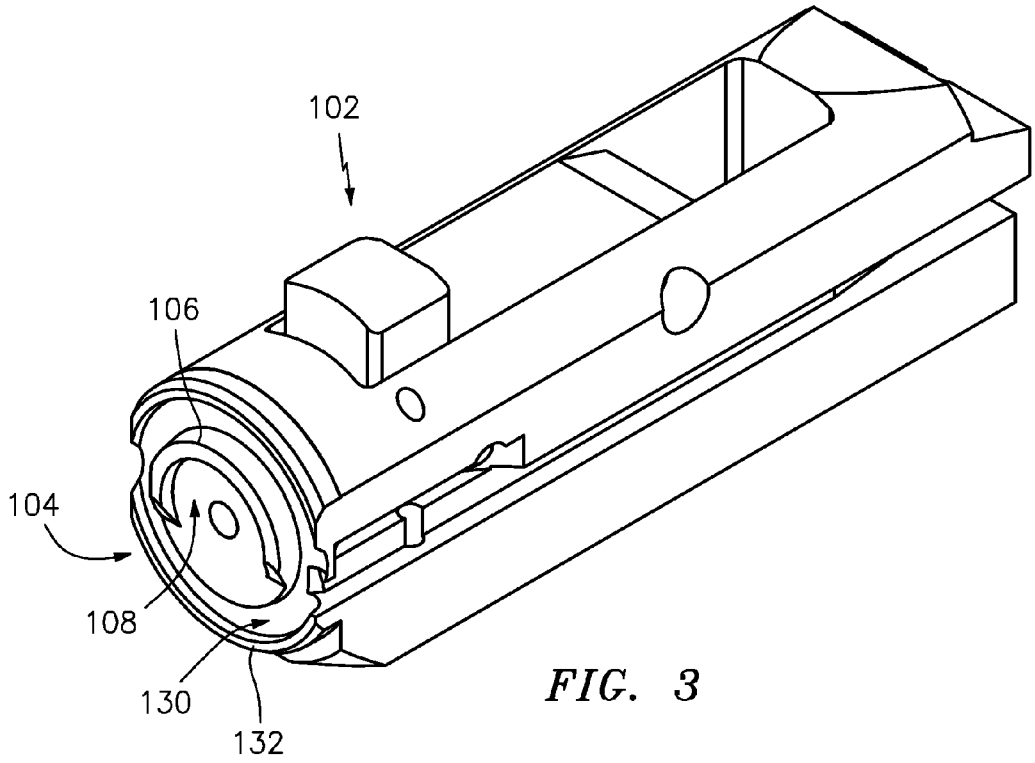
FIG. 3 is a perspective view of a breech bolt for launching an electrified projectile (e.g., from the XREP® cartridge) from the FIG. 1 shotgun.
Figure 4:
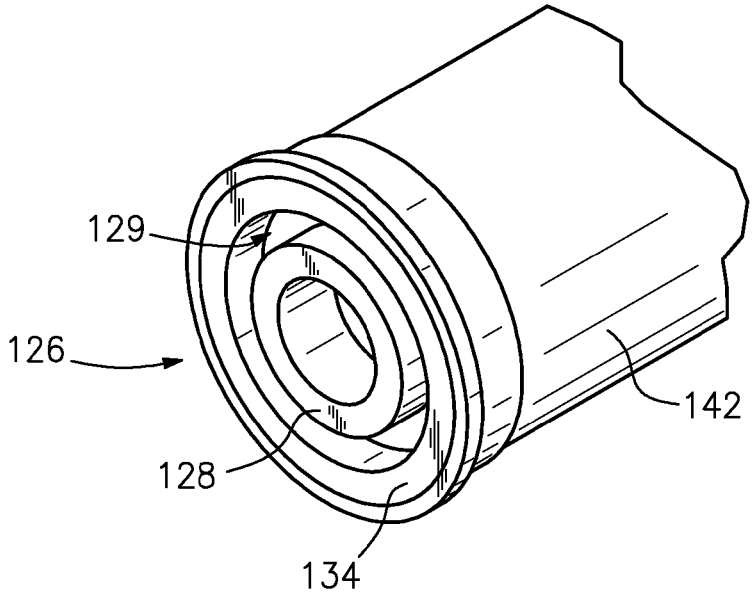
FIG. 4 is a perspective view of an XREP® cartridge end.

FIG. 3 is a perspective view of the preferred bolt end 104; and a correspondingly shaped portion within end 126 of cartridge 110. The cartridge end 126 has a recessed ring 128, surrounded by a recess 129. This recessed ring 128 is designed to nest within the central protrusion 106 (here, a chamfered half ring) of bolt end 104, no matter whether the cartridge 110 has been rotated about its longitudinal axis. In addition, the preferred bolt 102 has a second "concentric" recess 130, in end 104, just before an outer rim 132. This concentric recess 130 is designed to house an outer annular rim 134, of cartridge end 126, for stability.

Figure 5:
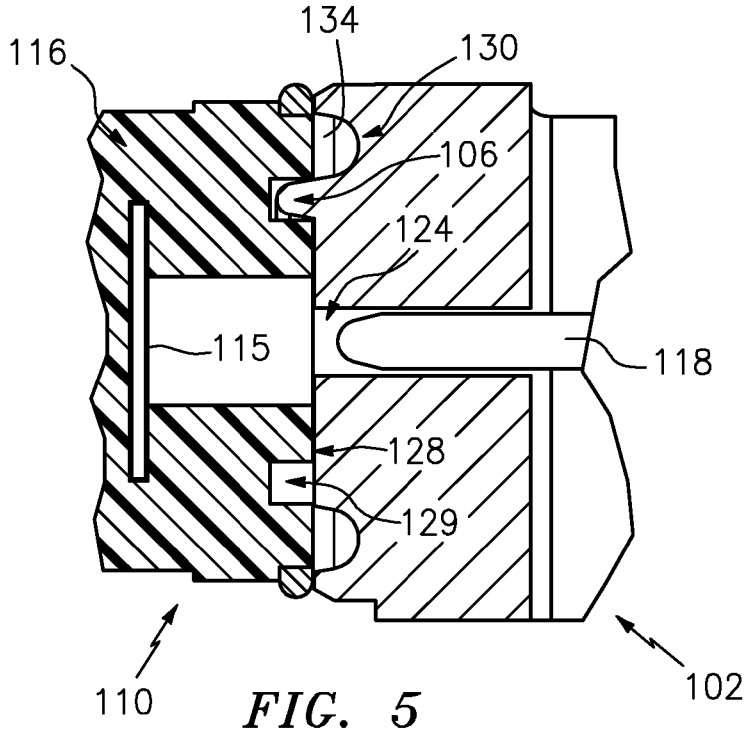
FIG. 5 is a cross-sectional view of the breech bolt and XREP® cartridge end nestled together.

FIG. 5 shows partial views of the cartridge 110 and bolt 102, in cross-section, nested together. Firing pin 118 is carried within central throughbore 124 of the bolt. Pin 118 can reach the electrified projectile's primer, during firing, because the cartridge 110 and bolt 102 are nested together.

Upon launching the electrified projectile cartridge 112, a standard extractor (not shown) in a shotgun (e.g., 100) can throw out the spent cartridge 110 upon opening the shotgun's ejection port at 136. Pulling back the forend 138: retracts the breech bolt 102; opens the port 136; and activates the extractor.

FIG. 6 is a perspective view of a standard shotshell 122. FIG. 7 is a cross-sectional view of the breech bolt 102 creating the excess head space at 120 for an abutting shotshell 122. Because of this excess head space 120, the firing pin 118 cannot reach the primer of the shotshell (see FIG. 7).

Applicants' invention preferably uses TASER® XREP® model cartridges. The TASER® XREP® cartridge (see FIG. 2) is a self-contained, wireless electronic control device (ECD), that deploys the electrified projectile 112 from a 12-gauge pump-action shotgun, such as the one depicted at 100. The projectile 112 delivers a similar Neuro Muscular Incapacitation bio-effect as the handheld TASER® X26™ ECD, but can be delivered to a maximum effective range of approximately 100 feet (30.48 meters), combining blunt impact force. A battery supply 140 is fully integrated into a projectile chassis and provides the power to drive the XREP® projectile engine.

Figure 2:
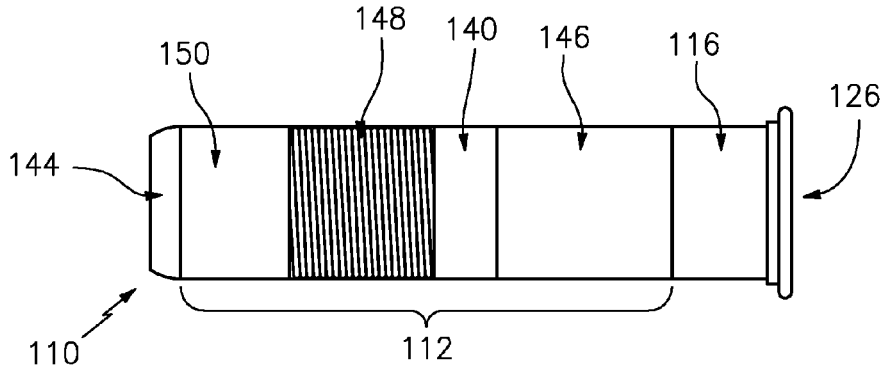
FIG. 2 is a simplified schematic of a TASER® XREP® cartridge, designed to be used with a pump shotgun.

Applicants' prefered TASER® XREP® cartridge 110 is schematically depicted at FIG. 2. That unspent cartridge 110 comprises: an outside shell/base 142 with primer 115; pyrotechnic propellant (at 116) stored within the outer shell 142, adjacent cap 115; projectile 112 totally contained inside the outer shell 142; and a wad 144 at a leading edge of the shell. Upon the propellant being activated, the wad 144 seals the fiream's barrel 145 to reduce gas escaping around the projectile 112, while in the barrel. The wad 144 falls away from the projectile 112 during flight of the projectile (e.g., after the projectile leaves the barrel). The base 142 (i.e., spent cartridge) remains with the firearm 100 after the projectile 112 (and wad 144) is launched.

The XREP® projectile 112 includes: a control unit 146; power supply (e.g., battery 140); coiled insulated wire 148; and electrodes 150 to generate a current through tissue of a target (not shown). The electrodes include barbs to attach the projectile 112 to the target. The wire 148 interconnects the barbs to the battery 140 and control unit 146.

Aside from the XREP® model, any suitable cartidge with an electrified projectile would do.

During quelling of a mob, a law enforcement officer or National Guardsmen will be able to fire a TASER® projectile but cannot accidentally fire lethal ammo. Payloads for law enforcement purposes may also assist SWAT team missions and general arrests.

Applicants' preferred apparatus can be thought of broadly in method terms as comprising:

a. opening a receiver of a shotgun by retracting a breech bolt having a central protrusion on a leading end;

b. inserting a cartridge, having an electrified projectile, into a breech of the firearm;

i. wherein the electrified projectile contains a primer and adjacent pyrotechnic propellant;

c. nesting an end portion of the cartridge within the protrusion of the bolt;

d. propelling the electrified projectile from the firearm by striking a firing pin of the shotgun against the primer, thereby igniting the pyrotechnic propellant, of the nested electrified projectile; and e. prohibiting, by the central protrusion of the bolt, the firing of lethal ammunition from the firearm.

Applicants' preferred method begins with opening the receiver to admit a cartridge.

The protrusion, mentioned in the above-described method, preferably is a half annulus.

The protrusion defines, when lethal ammunition is inserted in the receiver, an excess space which avoids the firing pin from reaching and hitting the primer.

It should be understood that obvious modifications can be made without departing from the spirit or scope of the invention. For example, the invention can be used with rifles or even pistols. In addition, any recess(es) and protrusion(es) on the bolt and cartridge could be reversed, with the bolt having the recess(es) and the cartridge having the protrusion(s). Accordingly, reference should be made primarily to the accompanying claims rather than the foregoing Specification.

We claim:

1. A method comprising:

a. opening a receiver of a shotgun by retracting a breech bolt having a central protrusion on a leading end;

b. inserting a cartridge, having an electrified projectile, into a breech of the shotgun;

i. wherein the cartridge contains a primer and a pyrotechnic propellant;

c. nesting an end portion of the cartridge within the protrusion of the bolt;

d. propelling the electrified projectile from the firearm by striking a firing pin of the shotgun against the primer, thereby igniting the pyrotechnic propellant, of the nested electrified projectile; and e. prohibiting, by the central protrusion of the bolt, the firing of lethal ammunition from the shotgun.

2. The method of claim 1 wherein the protrusion is a half annulus.

3. The method of claim 1 wherein the protrusion defines a recess.

4. The method of claim 1 wherein the protrusion defines, when lethal ammunition is inserted in the receiver, an excess space which avoids the firing pin from reaching and hitting the ammunition.

5. A method comprising:

a. opening a receiver of a firearm;

i. wherein the receiver contains a breech bolt;

b. inserting an electrified projectile into the opened receiver;

i. wherein the electrified projectile has a primer and adjacent pyrotechnic propellant;

c. nesting adjacent ends of the electrified projectile and breech bolt;

d. discharging the nested electrified projectile from the firearm by a firing pin of the firearm striking the primer, which ignites the primer, thereby igniting the pyrotechnic propellant; and e. incapacitating, by a protrusion of the bolt, the discharge of lethal ammunition placed in the receiver;

i. wherein the protrusion defines, when lethal ammunition is inserted in the receiver, an excess space which avoids the firing pin from reaching and hitting the primer.

6. The method of claim 5 wherein the protrusion is a half annulus rim.

7. An apparatus comprising:

a. a shotgun comprising:

i. a breech bolt having an end with a protrusion defining a recess;

ii. a firing pin moveable within a central throughbore of the bolt;

b. a cartridge, with an electrified projectile, having an end nested within the protrusion;

i. wherein the cartridge has a primer and adjacent pyrotechnic propellant;

c. wherein the nested projection is propelled from the firearm by striking a firing pin against the primer, thereby igniting the primer and the pyrotechnic propellant; and d. wherein the protrusion prohibits lethal ammunition from being discharged from the shotgun.

8. The apparatus of claim 7 wherein the protrusion is a half annulus.

9. An apparatus comprising:

a. a firearm comprising:

i. a breech bolt having an end with a protrusion defining a recess;

a firing pin moveable within a central throughbore of the bolt;

b. a cartridge, with an electrified projectile, having an end nested within the protrusion;

i. wherein the cartridge has a primer and adjacent pyrotechnic propellant; and c. wherein the nested projection is propelled from the firearm by striking a firing pin against the primer, thereby igniting the primer and the pyrotechnic propellant.

10. The apparatus of claim 9 wherein the protrusion defines an excess space for prohibiting lethal ammunition from being discharged from the firearm.

11. The apparatus of claim 9 wherein the protrusion is a half annulus.

* * * * *